US007467727B2

(12) United States Patent
Yuhara

(10) Patent No.: US 7,467,727 B2
(45) Date of Patent: Dec. 23, 2008

(54) COSMETIC CONTAINER

(75) Inventor: Yukitomo Yuhara, Abiko (JP)

(73) Assignee: Yoshida Industry Co., Ltd., Tokyo (JP)

( * ) Notice: Subject to any disclaimer, the term of this patent is extended or adjusted under 35 U.S.C. 154(b) by 505 days.

(21) Appl. No.: 11/366,818

(22) Filed: Mar. 3, 2006

(65) Prior Publication Data

US 2006/0196524 A1 Sep. 7, 2006

(30) Foreign Application Priority Data

Mar. 4, 2005 (JP) ..... 2005-060354

(51) Int. Cl.
*B65D 43/26* (2006.01)
*B65D 43/16* (2006.01)
*B65D 43/22* (2006.01)
*B65D 43/24* (2006.01)

(52) U.S. Cl. ..... 220/4.22; 220/827; 220/264; 220/283; 220/835

(58) Field of Classification Search ..... 220/827, 220/263, 264, 281, 283, 828, 829, 830, 833, 220/835, 4.22
See application file for complete search history.

(56) References Cited

U.S. PATENT DOCUMENTS 5,295,496 A * 3/1994 Machelett ..... 132/293
5,483,981 A * 1/1996 Vandromme et al. ..... 132/315
5,582,316 A * 12/1996 Masayoshi et al. ..... 220/264
5,647,498 A * 7/1997 Kaneko ..... 220/263
5,873,476 A * 2/1999 Takahashi et al. ..... 215/237
6,119,851 A * 9/2000 Paciello ..... 206/45.23
6,142,333 A * 11/2000 Sasamoto et al. ..... 220/264
6,253,938 B1 * 7/2001 Zaksenberg et al. ..... 215/237
6,345,637 B1 * 2/2002 Ko ..... 135/22
2002/0148802 A1 * 10/2002 Takahashi et al. ..... 215/237
2006/0096984 A1 * 5/2006 Bandoh et al. ..... 220/254.5
2006/0151416 A1 * 7/2006 Hennemann et al. ..... 215/235

FOREIGN PATENT DOCUMENTS

JP 6-46606 6/1994
JP 6-46613 6/1994

* cited by examiner

*Primary Examiner*—Anthony D Stashick
*Assistant Examiner*—Niki M Eloshway
(74) *Attorney, Agent, or Firm*—Morrison & Foerster LLP

(57) ABSTRACT

A portable cosmetic container basically comprises a container, a cover, and an inner dish, where an engagement of the container with the cover for sealing is constructed to be released by push-buttons located at the sides of the container while avoiding increase in the cosmetic container size. The elastic members 6*b* connected to the push-buttons 6*a*, face rearward to elastically deform toward the rear of the container 2, and the engaging projection 6*c* of the elastic members 6*b* formed to protrude toward the front of the container so as to engage with an engaging protrusion 15*a* of the cover 3 formed to protrude toward the rear of the container 2.

5 Claims, 4 Drawing Sheets

COSMETIC CONTAINER

CROSS-REFERENCE TO RELATED APPLICATIONS

The present application claims priority from Japanese Patent Application No. 2005-060354 filed on Mar. 4, 2005, which is herein incorporated by reference.

BACKGROUND OF THE INVENTION

1. Field of the Invention

The present invention relates to a cosmetic container of the type in which an engagement between a container and a cover for closing the container is configured to be released by pushing push-buttons located at both sides of the container, while avoiding- the increase in the container size.

2. Description of the Related Art

Of conventional cosmetic containers, there is known a type where the engagement between the container and the cover for closing the container is configured to be released by pushing the push-buttons provided at the sides of the container, such as those disclosed in Japanese Utility Model Application Laid-open Publications No. H06-46606 (hereafter, No. H06-46606) and No. H06-46613 (hereafter, No. H06-46613).

The "compact container" disclosed in No. H06-46606 comprises openings made at both sides of the container, a front shallow-groove and side shallow-grooves both extending from a circular shallow-groove provided at a center portion of an upper face of a container bottom wall to a front portion of the container bottom wall and both sides of the container bottom wall, respectively. Further, at each end portions of a front plate and connecting plates projecting out to the front and the side shallow-grooves, respectively, from the front and both side portions of an elastic ring loosely fit into the circular shallow-groove, there are installed a vertical engaging-plate with an engaging projection formed at a tip of a back face, and vertical pushing-plates that fit into the openings. Accordingly, there are achieved an opening of the cover with one hand holding the container with a pushing of the pushing-plates toward the inside to advance the front plate, and releasing the engagement between a hook of the cover and the engaging projection, thus presenting convenience of an opening enabled by one hand.

The "cosmetic compact container" disclosed in No. H06-46613 comprises an elastic annular-plate that deforms elastically by pushing of a pair of push-buttons penetrating through and projecting from both side walls of the container. The elastic annular-plate is connected to the bottom part of a cosmetic container plate. The connecting plate is formed to protrude from the front portion of and integral with the annular-plate. A seizing member is configured with a seizing plate vertically positioned to a front edge of the connecting plate that advances with the elastic deformation of the elastic annular-plate. Since a seizing protrusion projecting from the rear face of the seizing plate is structured to allow an engagement with a hook vertically provided at the front portion of the cover, enables an opening of the cover by pushing the button with the hand holding the container, it is argued that more convenience is attained than conventional containers of this type.

Both aforementioned conventional techniques employ the annular elastic ring or the elastic plate to push and advance the front plate or the connecting plate thereby disengaging the engaging protrusion or the seizing protrusion formed on the hook of the cover to release the engagement. Such annular elastic rings or the like are used by being pushed from the sides and causing their elastic deformation toward the front within the container etc. to disengage the hook from the engaging protrusion. Therefore, space required for the advancement of the front plate portion etc. has to be kept and even though the amount of cosmetic substance or the like contained therein does not change, there is a problem that the outer diameter of the container etc. must be enlarged just for such a purpose.

SUMMARY OF THE INVENTION

An object of the present invention is to provide a cosmetic container where an engagement between a container and a cover for closing the container is configured to be released by pushing a push-button located at a side of the container, while avoiding increase in the container size.

In order to accomplish the above and other objects, one aspect of the present invention comprise a container body, a cover having a hinge body, the cover being rotatably connected to the container body at the rear portion thereof by means of a hinge pin, a spring provided between the hinge body and the container body that constantly elastically urge the cover to be opened, an elastic member provided to the container, the elastic member having an engaging projection which comes into and out of mutual engagement with an engaging protrusion provided to the cover at the front portion of the container body, a push-button provided at a side of the container body to be pushed so that the elastic member is elastically deformed to release the engaging protrusion of the cover from the engaging projection, and a pressing member having a pressing portion for reducing a rotational speed of the hinge body by a frictional contact between the pressing portion and the hinge body, wherein the elastic member is connected to the push-button in a rearward displaced manner relative to the push-button to give the elastic member a characteristic of elastic deformation toward the rear of the container, wherein the engaging projection of the elastic member is formed to protrude toward the front of the container, and wherein the engaging protrusion of the cover is formed to protrude toward the rear of the container so that the engaging protrusion can be engaged with the engaging projection.

The pressing member may be impregnated with a lubricant agent. At least one reservoir groove may be provided to the pressing portion of the pressing member for accommodating the lubricant agent.

An adjuster may be provided to the container for slight adjustment of the frictional contact force presented by the pressing member.

The pressing member and a sliding contact portion of the hinge body that frictionally contacts the pressing member during a rotation of the cover may be formed in a manner so that mutual contact is achieved.

Features and objects of the present invention other than the above will become clear by reading the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings wherein.

DETAILED DESCRIPTION OF THE INVENTION

At least the following matters will be made clear by the explanation in the present specification and the description of the accompanying drawings.

Figure 1:
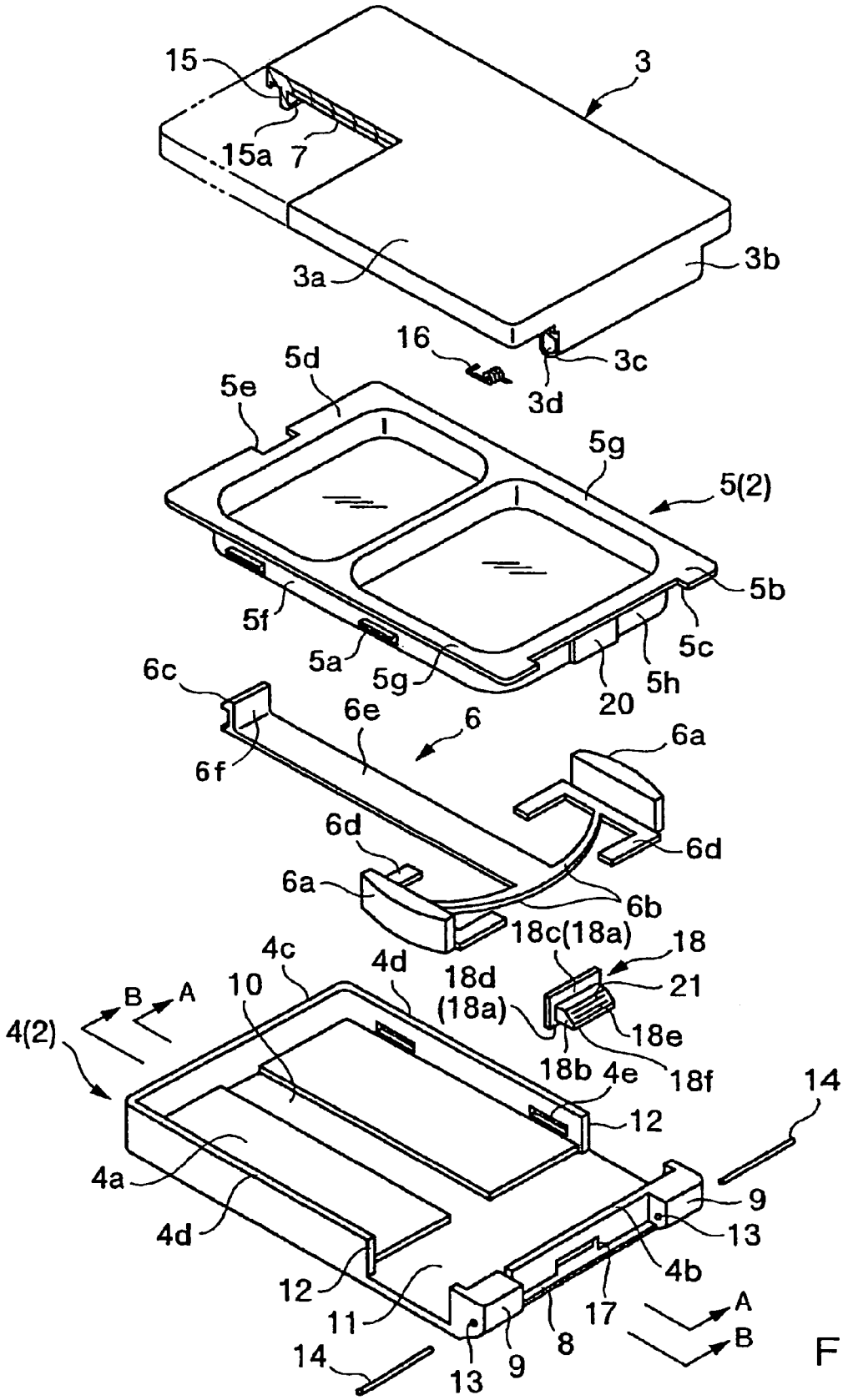
FIG. 1 is an exploded perspective view of a cosmetic container according to a implementation of the present invention.
Figure 2:
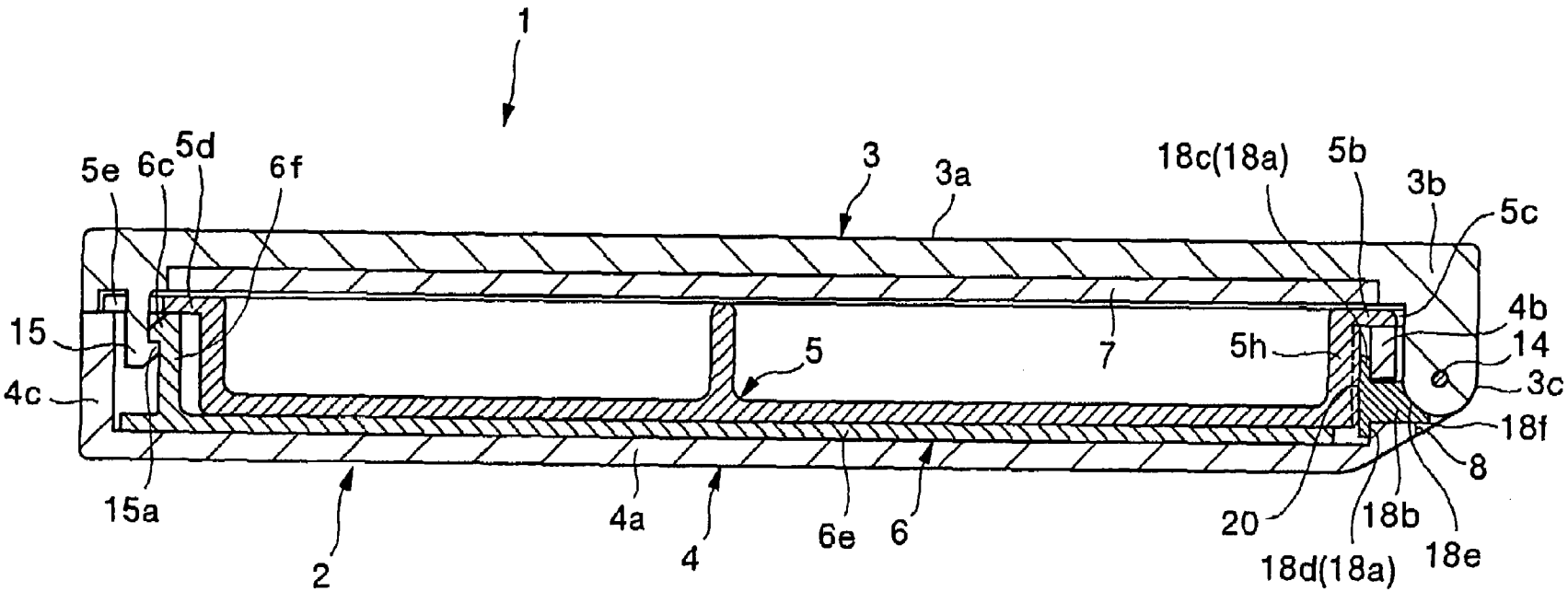
FIG. 2 is a side sectional view of the cosmetic container of FIG. 1.
Figure 3:
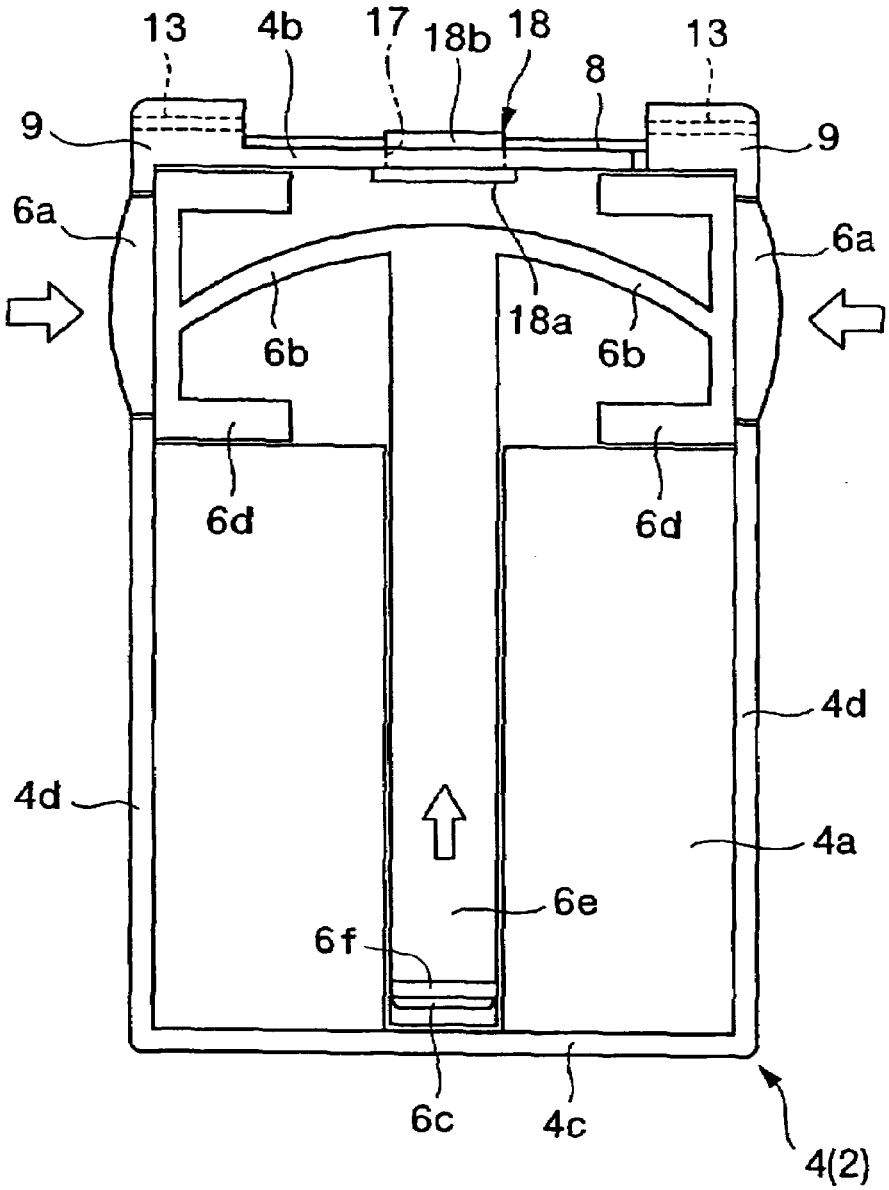
FIG. 3 is a top view of the cosmetic container of FIG. 1 with the inner dish and the cover removed.
Figure 4:
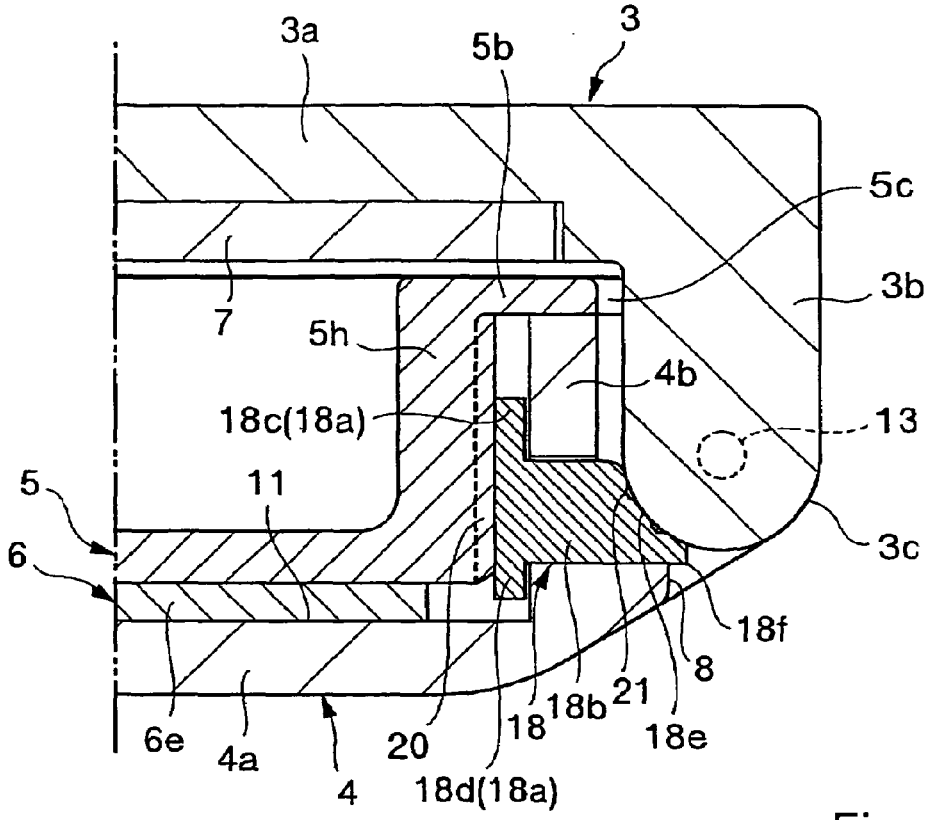
FIG. 4 is an enlarged fragmentary cross sectional view taken along line 'A-A' of the cosmetic container of FIG. 1.
Figure 5:
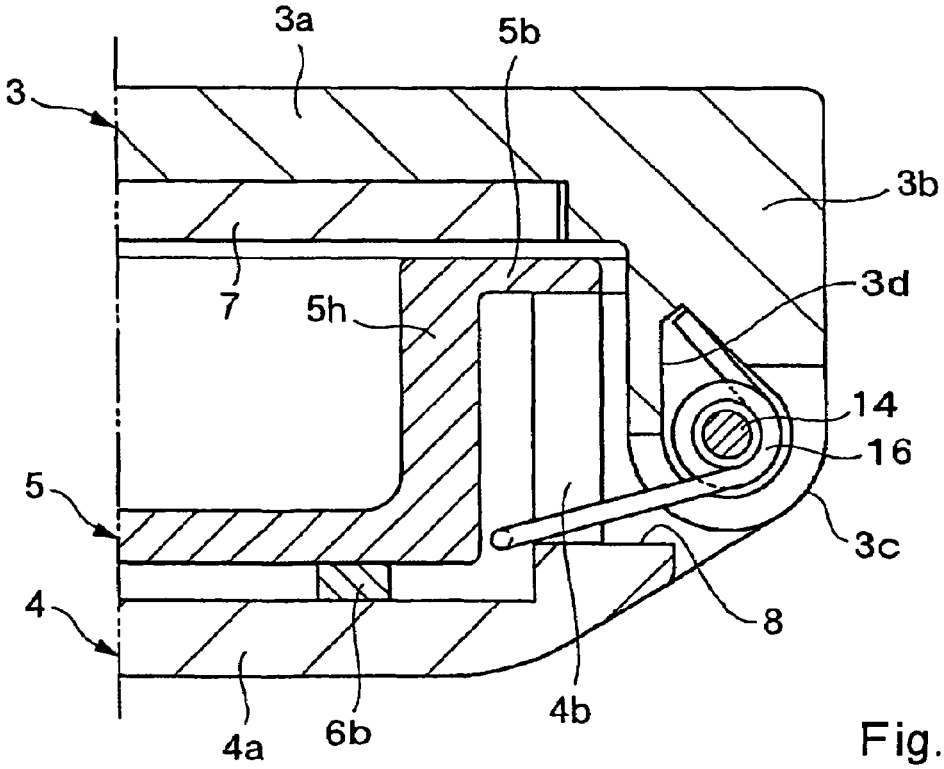
FIG. 5 is an enlarged fragmentary cross sectional view taken along line 'B-B' of the cosmetic container of FIG. 1.

With reference to the attached drawings, an implementation of the cosmetic container according to the present invention is described in detail. As shown in FIGS. 1 through 5, a cosmetic container 1 according to the implementation basically includes a container 2, a cover 3 and a manipulator 6. The container 2 is formed with a rear wall 4*b*, a front wall 4*c* and a pair of side walls 4*d* vertically arranged at the peripheral edges of a flat rectangular bottom wall 4*a*. In this way, the container 2 is constituted by a shell 4 with a room formed above the inner bottom wall 4*a*, and an inner dish 5 that fits into the room of the shell 4 by means of fittings provided by fitting bulges 5*a* and fitting recesses 4*e*.

The manipulator 6 is composed of such as integrally formed push-buttons 6*a*, elastic members 6*b* and an engaging projection 6*c*. The cover 3 is constituted by a cover body 3*a* attached to the backside of a mirror plate 7 and a hinge body 3*b* formed to protrude downward from the rear edge of the cover body 3*a*, rotatably joined to the shell 4 enabling an opening/closing of the shell 4. The container 2, cover 3 and each components of the manipulator 6 are all formed as molded resin products. It is needless to say that the shell 4 is not necessarily made in a flat rectangular shape, but can be circular or any other shape.

The shell 4 has a recess 8 formed at the center of the rear wall 4*b* that acts as a rear end thereof and a pair of hinge blocks 9 formed on both sides of the recess 8. In particular, there are formed by depressing the bottom wall 4*a* of the shell 4, between the sides of the shell 4, a longitudinal groove 10 running from proximate the front wall 4*c* to the rear direction and a lateral groove 11 connected in communication with the rear edge of the longitudinal groove 10, directed to each sides of the shell 4 due to reach the side walls 4*d*. On each of the side walls 4*d* an opening 12 is formed from the upper end thereof with a depth that reaches the longitudinal groove 10 and the lateral groove 11, and with a width same as the lateral groove 11.

The cover 3 has a hinge body 3*b* inserted into the recess 8 at the rear wall 4*b* of the shell 4, and the hinge body 3*b*, consequently the cover 3 are rotatably joined to the shell 4 to move up and down relative to the shell 4 by means of a hinge pin 14 inserted into a pin bore 13 that extends from the hinge block 9 formed on both sides of the recess 8 to the hinge body 3*b*. The shell 4 is sealed by the cover body 3*a* with a rotating movement allowing the opening/closing of the cover 3.

At the front edge of the cover body 3*a* of the cover 3 and in the middle between the sides thereof, a hook 15 is formed as a downwardly protruding lip directed toward the shell 4. An engaging protrusion 15*a* is formed proximate a bottom edge of the hook 15, to protrude in a backward direction (directed to the rear of the container 2).

In the present implementation, although the inner dish 5 is made to fit into the room of the shell 4 by means of the fittings, the scope of the invention is not limited hereto, as long as the inner dish 5 is fixed to the flat bottom wall 4*a* of the shell 4 by appropriate means such as ultrasound adhesion, to be housed within the room of the shell 4. Nevertheless, a cut 5*c* as well as a through-hole 5*e* are made to the inner dish 5 fixed within the shell 4 and to cover from above the longitudinal groove 10 and the lateral groove 11. The cut 5*c* is made in the rear flange 5*b* that covers the rear wall 4*b* of the shell 4 and corresponds to the recess 8 of the shell 4 so as to allow the hinge body 3*b* to be inserted into the recess 8 of the shell 4. The through-hole 5*e* is formed at the front flange 5*d* that covers the front wall 4*c* of the shell 4 and corresponds to the position of the hook 15 of the cover 3 so to allow the hook 15 to be inserted toward the shell 4.

The pair of push-buttons 6*a* at the sides of the manipulator 6 are disposed in a manner so that they slightly protrude out from the side walls 4*d* through the pair of openings 12 at the sides of the shell 4, and are slidable in a lateral direction within the space of the lateral groove 11. At the sides facing interior of the shell 4, the push-buttons 6*a* are formed with a flat U-shaped slide guide 6*d* to guide a sliding movement.

A slide strip 6*e* formed as a band extending from proximate the front edge to the lateral groove 11, is slidably disposed within the longitudinal groove 10 of the shell 4 so as to slide in a longitudinal direction guided by the longitudinal groove 10. An upward protruding stay 6*f* is integrally formed with the slide strip 6*e* at the front edge thereof, right under the through-hole 5*e* in the inner dish 5 and consequently at a position corresponding to the inserting hook 15 of the cover 3. An engaging projection 6*c* engageable with the engaging protrusion 15*a* of the hook 15 is formed to protrude toward the front of the shell 4 (toward the front of the container 2) at the upper end of the upward protruding stay 6*f*.

A pair of plate-form elastic members 6*b* reside at the rear end and on either sides of the slide strip 6*e*, and between the longitudinal center of the pair of slide guides 6*d* (longitudinal center of the pair of push-buttons 6*a*) at the sides with which the elastic members 6*b* are formed integrally with, and fit into the lateral groove 11. That is, the elastic members 6*b* are deployed within the lateral groove 11 by means of the slide strip 6*e* acting as a bridge between the pair of push-buttons 6*a* on either ends.

Although the elastic members 6*b* are formed in an arc-shape in the implementation, the scope of the invention is not limited hereto and as a matter of course, the elastic members 6*b* can be formed straight or in other shapes considered appropriate. Anyway, the elastic members 6*b* are formed with a nature to elastically deform toward the rear of the shell 4, between the slide strip 6*e* and the slide guides 6*d*, accordingly between the push-buttons 6*a*, directed rearward relative to the push-buttons 6*a*. As a result, when the push-buttons 6*a* are pushed from the sides toward the interior of the shell 4, the elastic members 6*b* are made to deform elastically toward the rear by the longitudinal groove 10 restricting the movement of the slide strip 6*e* in the longitudinal direction. In this way the slide strip 6*e* is made to move toward the rear of the shell 4. For this reason, the lateral groove 11 housing the elastic members 6*b* is formed with a width that allows the elastic deformation of the elastic members 6*b*.

The surrounding side walls 5*f* of the inner dish 5 and both side walls 4*d* of the shell 4 are slightly spaced apart in both side directions (not shown), and accordingly a space is formed between the surrounding wall 5*f* and the side walls 4*d* that allows the sliding movement of the push-buttons 6*a* pushed from both sides toward the inside of the shell 4. Further, a height of each push-button 6*a* is defined so that the top end of the push-button 6*a* is flush with the top of the side walls 4*d* of the shell 4.

The hinge body 3*b* of the cover 3 has a sliding portion 3*c* that comes to the bottom thereof when the cover 3 is closed, formed with an arc-shaped side section, to be more specific, formed in an arc-shape with a radius substantially uniform from the hinge pin serving as the center thereof, so that the hinge body 3*b* can rotate smoothly within the recess 8. A concave portion 3*d* is formed at the edge faces that face either of the hinge blocks 9. Within this concave portion 3*d*, a torsion spring 16 is set with one end thereof latched to the shell 4 and the other end to the hinge body 3*b* serving as a spring that is constantly biased in a direction to snap open the cover 3. The spring biased to snap open the cover 3 is not limited hereto, but may be other means to snap open the cover 3 such as a coil spring or a leaf spring. The location of the spring is also not specifically limited as long as it is in an appropriate position between the hinge body 3*b* and the shell 4 of the container 2.

An attachment aperture 17 is formed by penetrating the rear wall 4*b* of the shell 4 at the lower-center edge thereof. A pressing member 18 frictionally contacting with the hinge body 3*b* to reduce its rotational speed is disposed to project out from the attachment aperture 17 toward the recess 8. This pressing member 18 is fabricated from flexible elastic material such as silicon rubber, comprised of a retaining flange 18*a* positioned at the inner side of the shell 4 than the attachment aperture 17, which spreads to all sides to prevent the pressing member 18 from falling out through the attachment aperture 17, and a pressing block 18*b* disposed to project out toward the recess 8 where the hinge body 3*b* is located. The pressing block 18*b* does not need to contact the hinge body 3*b* when the cover 3 is in a sealing position and can be organized to come into contact with the hinge body 3*b* during an opening of the cover 3.

The retaining flange 18*a* is located above the lateral groove 11 and positioned substantially parallel to the rear wall 4*b* of the shell 4. The bottom edge of the retaining flange 18*a* protrudes close to the lateral groove 11 surface. Of the protrusions 18*c* and 18*d* protruding upward and downward of the retaining flange 18*a*, the size of the protrusion 18*c* is made larger than the protrusion 18*d* to avoid confusion between the two when attaching the pressing member 18 in an assembly process.

Although the pressing member 18 is engaged so that it does not drop completely outside the rear wall 4*b*, it is not fixed and is enabled to move slightly relative to the attachment aperture 17 in the longitudinal direction of the container 2. Therefore, the pressing force presented against the hinge body 3*b* can be adjusted according to the position of the pressing member 18, specifically, when it is positioned close to the front of the container 2, the pressing force presented against the hinge 3*b* becomes smaller and when it is positioned close to the rear of the container 2, the pressing force presented against the hinge 3*b* becomes larger.

An adjuster 20 is an element for adjusting the position of the hinge body 3*b* in the longitudinal direction and is provided at the lateral center of the surrounding rear wall 5*h* of the inner dish 5. This adjuster 20 comes into contact with the backside of the retaining flange 18*a* of the pressing member 18 to push the pressing block 18*b* toward the hinge body 3*b*. For example, when the cosmetic container 1 is used in a place with extreme temperature, it can be assumed that due to the changes in the hardness of the pressing member 18, the frictional force generated between the pressing block 18*b* and the hinge body 3*b* is slightly affected. When the cosmetic container 1 is distributed in such places, a change in the thickness of the adjuster 20 of the inner dish 5 enables a slight and easy adjustment of the pressing force produced by the pressing member 18 against the hinge body 3*b*, consequently a slowdown of the rotational speed according to the frictional sliding action.

At a design phase, the adjustment of the rotational speed by the frictional sliding action by the pressing member 18 pressing against the hinge body 3*b* is basically performed by changing the dimension and position, material and shape of the pressing member 18 (particularly the pressing block 18*b*) and the hinge body 3*b* while the adjuster 20 should perform fine adjustment among others at the production stage. In the present implementation, the adjuster 20 is formed to protrude from and integral with the surrounding rear wall 5*h* of the inner dish 5, however its structure is not limited to such and may be configured by attaching single or plural layers of thin tape. Alternatively, the adjuster 20 can be omitted.

In the present implementation, the profile of the upper edge portion 18*e* of the pressing block 18*b* being the pressing portion frictionally contacting the hinge body 3*b*, is defined to form an arc-shape having a same diameter as the sliding portion 3*c*. Formed in this way, during the rotation of the hinge body 3*b*, since the contact area between the two, particularly because the distance in the rotating direction is maintained relatively long, the frictional force is generated in a wide area between the two to realize the slowdown of the rotational speed in a much stable manner.

More specifically, as in a conventional manner for example, when the upper edge portion 18*e* of the pressing block 18*b* is in a block form as the lower edge portion 18*f* (that is, when the entire pressing block 18*b* is in a cubic form) without any pre-shaping of the upper edge portion 18*e* of the entire pressing block 18*b* unlike the present implementation, frictional contact between the pressing member 18 and the hinge body 3*b* is made in a linear state with a small contact area. For such reason, it is believed that there is an extreme difference in the slowdown effect caused between the cases where the pushing force of the pressing member 18 working against the hinge body 3*b* is large and small.

In the present implementation, however, in the pressing block 18*b*, the shapes of the upper edge portion 18*e* which is the pressing portion working against hinge body 3*b* and the sliding portion 3*c* of the hinge body 3*b* that frictionally contacts the upper edge portion 18*e* are formed in an arc-shape to increase the mutual contact area as described above. In this way, the slowdown effect on the rotational speed of the hinge body 3*b* is realized in a stable manner. Additionally, the profile of the upper edge portion 18*e* and the sliding portion 3*c* are not limited to an arc-shape as long as the two are formed to develop mutual contact. For example, the sliding portion 3*c* can be formed as an arc-shape and the upper edge portion 18*e* is chamfered.

The pressing member 18 of the present implementation is formed to be impregnated with a lubricant agent such as silicon oil and ethylene glycol so that smooth frictional sliding between the hinge body 3*b* and the pressing block 18*b* is maintained. The impregnated lubricant agent exudes from the pressing member 18, particularly the upper edge portion 18*e* that pressure contacts with the hinge body 3*b* over a long period of time to realize lubricating action.

The upper edge portion 18*e* is formed with two reservoir grooves 21 for accommodating the exuded lubricant agent. The frictional contact between the pressing member 18 and the hinge body 3*b* has an effect of gradually removing the lubricant agent affixed on the upper edge portion 18*e*. In the present implementation, however, a specific amount of lubricant agent is always accommodated within the reservoir grooves 21 enabling a stable supply of the lubricant agent from the reservoir grooves 21 to the upper edge portion 18*e*, thus constantly maintaining a smooth lubrication.

Hereinbelow will be described the actions of the cosmetic container of the present implementation. The cosmetic container 1 is fabricated by attaching the torsion spring 16 to the shell 4, assembling the cover 3 to the shell 4 by means of the hinge pin 14 followed by letting the pressing block 18*b* of the pressing member 18 go into the attachment aperture 17 from the interior of the shell 4 and while maintaining this condition, the manipulator 6 and the inner dish 5 are incorporated into the shell 4. During the fabrication, the manipulator 6 is fit into the longitudinal groove 10 and the lateral groove 11 of the shell 4.

In order to open the container 2, the pair of push-buttons 6*a* projecting from the side walls 4*d* may be pushed with fingers etc. toward the interior of the shell 4 from both sides thereof. Here the sliding movements of the pair of push-buttons 6*a* are guided by the slide guides 6*d* sliding inside the lateral groove 11. Further, since the slide strip 6*e* is held within the longitudinal groove 10 from both sides, the elastic members 6*b* elastically deforms toward the rear, and therewith the slide strip 6*e* slides toward the rear within the lateral groove 11. Together with the sliding of the slide strip 6*e* toward the rear, the engaging projection 6*c* of the upward protruding stay 6*f* moves rearward and thus the engagement between the hook 15 of the cover 3 and the engaging protrusion 15*a* is released.

When the engagement between the engaging protrusion 15*a* and the engaging projection 6*c* is released, the cover 3 is automatically moved upward in the opening direction by the torsion spring 16 biased to snap, while the hook 15 passes through the through-hole 5*e* of the inner dish 5 and the container 2 keeps on being opened. At this event, with the opening of the cover 3, the speed of the rotating hinge body 3*b* urged by the torsion spring 16 is reduced by the frictional sliding action caused between the pressing member 18 and the rotating hinge body 3*b*.

The effects by the lubricant agent with which the pressing member 18 is impregnated keeps the rotational movement of the hinge body 3*b* smooth for a long period of time. At the pressing block 18*b*, the exuded lubricant agent accommodated in the reservoir grooves 21 provided at the upper edge portion 18*e* coming into frictional contact with the hinge body 3*b*, is supplied to the upper edge portion 18*e* in a stable manner constantly enabling a smooth rotation of the hinge body 3*b*.

Following the opening of the cover 3, when the fingers free the push-buttons 6*a*, an elastic restoration of the elastic members 6*b* moves the push-buttons 6*a* back into its initial position to project outward from the side walls 4*d* of the shell 4, and the engaging projection 6*c* together with the slide strip 6*e* back to a position at the front.

When the container 2 is shut, the cover 3 moves in a closing direction with the hook 15 passing through the through-hole 5*e* to be inserted into the shell 4. During this, the engaging protrusion 15*a* pushes the engaging projection 6*c* of the slide strip 6*e* backward and together with a rearward movement of the slide strip 6*e* accompanied by a slight elastic deformation of the elastic members 6*b*, the engaging protrusion 15*a* makes its way to go under the engaging projection 6*c* to come into engagement therewith, and in this way the container 2 can establish a sealing state.

As described above, in the cosmetic container 1 according to the present implementation, the elastic members 6*b* moved with the push-buttons 6*a* to release the engagement between the cover 3 and the container 2, are directed rearward so as to provide a characteristic of elastic deformation toward the rear of the container 2. Together, the engaging projection 6*c* formed to protrude toward the front of the container 2, is provided to the slide strip 6*e* that transfers the movement of the elastic members 6*b*. Further, the engaging protrusion 15*a* of the cover 3 is formed to protrude toward the rear of the container 2 to engage with the engaging projection 6*c*. With such a structure, when the engagement between the engaging protrusion 15*a* and the engaging projection 6*c* is released, space for the engaging projection 6*c* positioned at the front portion of the container 2 to move rearward is all that is required, and this can be acquired with the use of an initial space of the container. Therefore, space required for advancement of the slide strip 6*e* within a conventional container 2 (within a shell 4) is no longer needed so that the size of the container is prevented from increasing and consequently reducing its overall size.

The push-buttons 6*a* can slide in both side directions in a stable manner while the elastic members 6*b* are structured to be connected to and directed rearward relative to the push-buttons 6*a* due to elastic deforming toward the rear relative to the push-buttons 6*a*, since the sliding movements of the push-buttons 6*a* are guided by the lateral groove 11 and the slide guide 6*d*.

The pressing member 18 set to the container 2 can reduce the rotational speed of the hinge body 3*b* when the cover 3 opens, and as a result a moderate opening action of the cover 3 can be realized.

Since the pressing member 18 is impregnated with the lubricant agent, the frictional sliding action between the hinge body 3*b* and the pressing member 18 is maintained smooth for a long period of time.

Since the reservoir grooves 21 for accommodating the exuded lubricant agent are provided at the upper edge portion 18*e* being the portion where the pressing block 18*b* of the pressing member 18 and the hinge body 3*b* come into frictional contact, the supply of lubricant agent from the reservoir grooves 21 to the upper edge portion 18*e* is maintained in a stable manner and thus a smooth frictional sliding action between the hinge body 3*b* and the pressing member 18 is constantly maintained.

The adjuster 20 contacting the backside of the retaining flange 18*a* of the pressing member 18 is arranged to allow a fine adjustment of the frictional contact force yield by the pressing member 18 working against the hinge body 3*b*. In this way, for example, a fine adjustment required to slow down the rotational speed of the hinge body 3*b* at the fabrication stage according to the climate condition of the place where the cosmetic container is to be distributed can be performed easily.

The pressure contacting portion of the pressing member 18, that is the upper edge portion 18*e* and the sliding portion 3*c* of the hinge body 3*b* that frictionally contacts the upper edge portion 18*e* when the cover 3 rotates, are formed in an arc-shape so that the faces of the two contact each other. In this way the slowdown effect on the rotational speed of the hinge body 3*b* is realized in a stable manner. As a result, in such a case where the pushing force applied to the hinge body 3*b* of the pressing member 18 varies, problems of extreme changes in the slowdown effect on the rotational speed such as the rotational speed becoming too slow or on the other hand not being reduced at all can be prevented.

In the implementation described above a pair of push-buttons 6*a*, elastic members 6*b*, slide guides 6*d*, lateral grooves 11 and openings 12 on either side of the container 2 are included. However, the container 2 can be constructed to have these only on one side.

The cosmetic container according to the present invention can prevent a cosmetic container from increasing in size with the engagement of the container with the cover for closing the container is structured to be released with push-buttons located at the side portions of the container.

Although a cosmetic container according to the present invention has been described in detail with referring to the specific implementations, the above description is provided to facilitate the understanding of the present invention and not intended to limit the present invention. It should be understood that various changes and alterations can be made therein without departing from the spirit and scope of the invention and that the present invention includes its equivalents.

What is claimed is:

1. A cosmetic container comprising:

a container body;

a cover having a hinge body, the cover being rotatably connected to the container body at the rear portion thereof by means of a hinge pin;

a spring provided between the hinge body and the container body that constantly elastically urge the cover to be opened;

an elastic member provided to the container, the elastic member having an engaging projection which comes into and out of mutual engagement with an engaging protrusion provided to the cover at the front portion of the container body;

a push-button provided at a side of the container body to be pushed so that the elastic member is elastically deformed to release the engaging protrusion of the cover from the engaging projection; and a pressing member having a pressing portion for reducing a rotational speed of the hinge body by a frictional contact between the pressing portion and the hinge body, wherein the elastic member is connected to the push-button in a rearward displaced manner relative to the push-button to give the elastic member a characteristic of elastic deformation toward the rear of the container, wherein the engaging projection of the elastic member is formed to protrude toward the front of the container, and wherein the engaging protrusion of the cover is formed to protrude toward the rear of the container so that the engaging protrusion can be engaged with the engaging projection.

2. The cosmetic container claimed in claim 1, wherein the pressing member is impregnated with a lubricant agent.

3. The cosmetic container claimed in claim 2, wherein at least one reservoir groove is provided to the pressing portion of the pressing member for accommodating the lubricant agent.

4. The cosmetic container claimed in claim 1, wherein an adjuster is provided to the container for slight adjustment of the frictional contact force presented by the pressing member.

5. The cosmetic container claimed in claim 1, wherein the pressing member and a sliding contact portion of the hinge body that frictionally contacts the pressing member during a rotation of the cover, are formed in a manner so that mutual contact is achieved.

* * * * *